US005579963A

United States Patent [19]

Murthi

[11] Patent Number: 5,579,963

[45] Date of Patent: Dec. 3, 1996

[54] UNIVERSAL SPOUT AND SPLASH GUARD

[76] Inventor: Raghu Murthi, 3233 NW. 128th Pl., Portland, Oreg. 97229

[21] Appl. No.: 558,959

[22] Filed: Nov. 13, 1995

[51] Int. Cl.[6] ..... B65D 5/72

[52] U.S. Cl. ..... 222/570

[58] Field of Search ..... 222/568, 570

[56] References Cited

U.S. PATENT DOCUMENTS

| | | | |
|---|---|---|---|
| 1,210,240 | 12/1916 | Wemett | 222/568 |
| 1,867,060 | 7/1932 | Carr | 222/570 |
| 2,601,190 | 6/1952 | Wells | 220/90 |
| 2,627,367 | 2/1953 | Bork | 222/570 |
| 2,668,635 | 2/1954 | Bennett | 220/85 |
| 3,074,604 | 1/1963 | Baroud | 222/569 |
| 3,273,746 | 9/1966 | Andrews, Jr. | 220/90 |
| 3,961,732 | 6/1976 | Roberts | 222/570 |
| 4,299,340 | 11/1981 | Hrytzak | 222/570 X |
| 4,736,874 | 4/1988 | Durant | 222/570 |
| 4,813,579 | 3/1989 | Ciumaga | 222/570 |
| 4,844,281 | 7/1989 | Bradford | 220/90 |
| 5,123,576 | 6/1992 | Lawrence | 222/570 |
| 5,195,662 | 3/1993 | Neff | 222/108 |
| 5,234,133 | 8/1993 | Kensey | 222/189 |

*Primary Examiner*—Gregory L. Huson
*Attorney, Agent, or Firm*—William S. Lovell

[57] ABSTRACT

An attachment for use with paint cans, kitchen containers, laboratory equipment and the like in a wide range of sizes serves to prevent both spillage when pouring liquids from such containers or splashing when pouring liquids into such containers. Attachment and detachment of the device is rapid, involving merely slipping the device on and off in one embodiment, or the turning of a simple knob on several attachment clips in another embodiment. Variations in the design of specific instances of the device may be made to accommodate liquids having widely different viscosity.

8 Claims, 2 Drawing Sheets

UNIVERSAL SPOUT AND SPLASH GUARD

BACKGROUND OF THE INVENTION

1. Field of the Invention

This invention relates to apparatus adapted to facilitate the pouring of a liquid from one container to another, for the avoidance of spillage in the pouring process and the avoidance of splashing in receiving a poured liquid.

2. Background Information

In the kitchen, or elsewhere in the home or shop, it is frequently necessary to pour liquids from one container to another. Such liquids may be hot, corrosive, or may comprise paint or the like that a user does not wish to have spread about, and for that reason it can be important to ensure that no liquid is lost to the surroundings, either by spillage or by splashing. The present invention provides means for avoiding both ways for losing liquid to the surroundings.

By "spillage" is meant the pouring of liquid onto locations not desired, as when a part of a body of liquid that is being poured into a receptacle is misdirected elsewhere, e.g., so as to pour onto a table or the like on which the receiving receptacle is placed. Devices that are intended to avoid such spillage are termed "spouts" in this discussion.

By "splashing" is meant the secondary transport of liquid out of a receptacle into which it is being poured, i.e., the liquid is directed into the receiving receptacle as desired, but a portion of the liquid "splashes" on out, e.g., again onto a table or the like on which the receiving receptacle is placed. Devices that are intended to avoid such splashing are termed "splash guards" in this discussion.

Previous efforts to avoid these undesired events have generally fallen into the two classes indicated, i.e., into pouring devices and splash guards. Thus, in U.S. Pat. No. 1,867,060 issued Jul. 12, 1932 to Carr, a curved spout having the same radius of curvature as the container to which the spout is to be attached includes on the lower periphery thereof an upward-turning lip that is adapted to fit within a downward facing lip of the container, e.g., as may be provided in a paint can. This device is thus limited in application to containers that indeed include such a downward turning lip.

Similarly, U.S. Pat. No. 2,627,367 issued Feb. 3, 1953 to Bork describes a detachable spout for paint cans that is to be inserted into the same circumferential groove in the can in which the can lid is placed. Thus, this invention comprises in a first component a continuous flange that fits downwardly into that can groove; and as a second component, a spout for pouring purposes extending upwardly and outwardly from one side of that continuous flange. This device is again limited in application to paint cans or the like that provide such an upwardly-facing circumferential groove.

U.S. Pat. No. 3,074,604 issued Jan. 22, 1963 to Baroud likewise describes a device adapted to fit into the upwardly-facing groove of a paint can, but in this case into only a portion thereof. The device is further provided with an upwardly-facing flat surface adapted for placement thereon of a paint brush, and centrally within said flat surface there is provided an outwardly-pointing groove which narrows in width going outwardly, thus to serve as a pouring spout.

U.S. Pat. No. 4,299,340 issued Nov. 10, 1981 to Hrytzak describes a paint can attachment comprising a trough-shaped pouring spout that is attached to the top of the can by two hooks on each side of said trough, one of said hooks being placed inside the can on the underside of a downwardly-descending lip, and the other of being snapped under an outer rim on the top periphery of the can.

In a somewhat different perspective. U.S. Pat. No. 4,736,874 issued Apr. 12, 1988 to Durant, describes a device, i.e., a collar insert that by virtue of having a wedged shape engages frictionally with the interior rim of a paint can, that is principally adapted to prevent the entry of paint into the annular groove that encircles the top of a paint can (into which is placed the can lid), said device also being adapted to accept an attached pouring or filtering spout.

Also with respect to paint cans, U.S. Pat. No. 4,813,579 issued Mar. 21, 1989 to Ciumaga describes a two-component device comprising firstly a pouring member and secondly a locking member attached to said pouring member and adapted for insertion under and behind the annular bead that in a paint can marks the inner periphery of the top thereof, i.e., which defines the circumference of the can opening. The device is attached to a paint can by first flexing the device an amount sufficient to permit passing the same into the interior of the top of the paint can; relaxation of that flexion until the radius of curvature of the device (and in particular the radius of curvature of the locking member) matches that of the aforementioned interior bead; and then moving the device upwardly so that a portion of the locking member is placed between that bead and the interior wall of the annular groove into which the can lid would be placed with the lid present.

U.S. Pat. No. 5,195,662 issued Mar. 23, 1993 to Neff describes a paint can spout that features an interior paint brush wiping bar. Attachment of the device is essentially by placing an interior lip thereof under the annular bead which defines the circumference of the can opening, and then placing an outer lip thereof under the outer bead on the exterior rim of the can.

U.S. Pat. No. 5,234,133 issued Aug. 10, 1993 to Kensey describes another pouring device adapted for use with containers such as paint cans that have an interior annular rim (defining the container opening) and an adjacent annular channel. Attachment of the device to the container is by means of an annular split retainer that is bent to fit and placed inwardly from and against the interior annular rim, whereby the resilient force of the retainer holds the same in place against the rim. Some particular one of several types of spout, funnel and filter devices may then be attached to that retainer for carrying out the corresponding function in removing liquid from the container.

As noted earlier, other devices have been conceived for the purpose of preventing splashing when a liquid is poured into a can. With regard to paint cans in particular, such event can occur when pouring into the can in the normal sense, but also when a paint brush that has been immersed in the paint is lifted out (or is wiped against the rim of the can opening) and commences to drip paint back into the can. In either case, it is desired to prevent paint from entering into the annular groove about the top of the can into which a corresponding rim of the lid to the can is placed. U.S. Pat. No. 2,601,190 issued Jun. 17, 1952 to Wells describes one such device, which essentially comprises an annular body having at the upper periphery thereof an annular, inwardly-sloping rim that extends outwardly from the top periphery of the can; at the bottom periphery thereof an annular, inwardly-sloping skirt that extends downwardly into the can interior; and passing through slots in that annular body a U-shaped flexible bail with outwardly extending trunnions that may be placed to fit beneath the shoulder-forming upper can rim by compressing the sides of the bail together and then slipping the trunnions under the can rim. The bail may be used as a handle for carrying the can to which the device has been attached, the trunnions terminating in stop lugs that encounter the slot edges so as to prevent compression of the bail when the same is in an upright position, but when in a different position permit compression and hence removal of the device from a can.

U.S. Pat. No. 2,668,635 issued Feb. 9, 1954 to Bennett describes an annular shield or bib formed from a flexible sheet that may be shaped to be inserted at a lower portion thereof into the annular channel at the top of a paint can, said shield then extending upwardly and outwardly so as to shield both that channel and the outside wall of the can from spillage or splashing. It is indicated that attachment of the device to the can may be by adhesive, clips, snaps, or the like. U.S. Pat. No. 3,273,746 issued Sep. 20, 1966 to Andrews, Jr., describes a similar bib or shield that incorporates a brush holder and wiper and attaches by placement within the can opening. In this case, the bib or shield has a series of supports which hold the upper draining portion of the device above the top annular channel of the can. U.S. Pat. No. 4,844,281 issued Jul. 4, 1989 to Bradford describes another device that is placed onto and over the open-container rim to prevent paint from entering the adjacent channel, and which includes a tapering vertical wall, web and land for placement of a paint brush to as to drain back into the can.

U.S. Pat. No. 5,123,576 issued Jun. 23, 1992 to Lawrence describes a paint tray adapted to accommodate a paint roller, the assembly as a whole fitting down into the top of an opened paint can, and the portion thereof that is over the contained paint being open for access thereto by either a brush or roller. The tray has a rounded extremity over about half of the region nearmost to the paint can, and extends as a rectangle in an opposite direction. The tray as a whole has outer walls for preventing splashing or spillage, and centermost to the rounded portion thereof has a tapering, rounded bend extending outwardly to serve as a pouring spout.

In spite of the foregoing, however, there remains the problem of pouring paint and other such liquids into and out of various round or rectangular shaped containers without spillage or splashing, and in a way that is both convenient and economical. In particular, the majority of the described devices depend for their attachment and use upon the annular inner rim and channel, and in some cases even the specific inner and outer beads, that characterize the ordinary paint can. Moreover, the devices described are generally rather complex in construction which can make them relatively costly. Consequently, for purposes of home canning or cooking, the laboratory manipulation of liquid chemicals, and a wide range of other such functions, there remains a need for a simple and inexpensive pouring spout and splash guard device that is adapted for use with a correspondingly wide range of liquid containers, the bulk of which may not have the same upper construction as does a paint can.

SUMMARY OF THE INVENTION

The invention comprises an apparatus adapted for convenient attachment onto any type of cylindrical or rectangular container from which a liquid is to be poured so as to avoid spillage in pouring, or into which liquid is to be poured so as to avoid splashing. The embodiment of the invention to be used with cylindrical containers is sufficiently flexible to accommodate itself to the radius of curvature of the walls of a wide variety of containers. Both in that embodiment and in that intended for use with containers having straight walls, the invention provides quick and easy means for attachment thereto, i.e., by slipping one end of the apparatus down into the interior of a container and then securing the apparatus as a whole against the outer wall of the container, irrespective of the structure of the container top. Securing of the device can be accomplished either by hand-turning several locking bolts which pass through corresponding attachment clips and press against that outer wall, or by inherent compression of several locking clips against the outer wall.

BRIEF DESCRIPTION OF THE DRAWINGS

The preferred embodiments of the invention will now be described in detail with reference to the accompanying drawings, in which.

DETAILED DESCRIPTION OF THE INVENTION

Figure 1A:
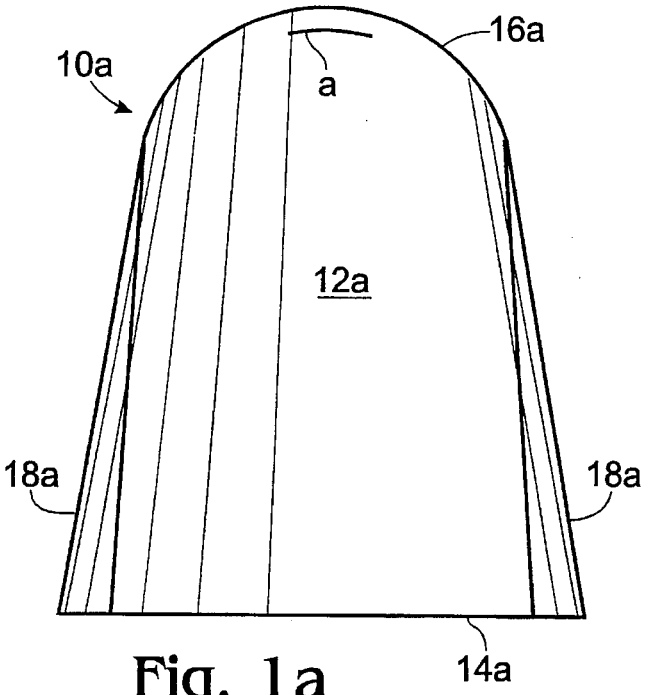
FIGS. 1*a* and 1*b* show front elevation views of alternative preferred embodiments of the invention having different tapers.

A front elevation view of a preferred embodiment of the invention is shown in FIG. 1*a* as a universal spout and splash guard designated as apparatus 10*a*. The main body of apparatus 10*a* comprises a sheet 12*a* of semi-rigid but flexible material such as plastic or light aluminum having a lower, flat edge 14*a* and an upper, rounded edge 16*a* having a radius of curvature a that for use with different liquids may be given particular selected values. That is, for highly viscous liquids a somewhat large radius of curvature (e.g., as shown in FIG. 1*a*) might need to be employed to facilitate liquid flow, while for a liquid of low viscosity, a much sharper curvature (smaller radius of curvature) that would yield a device much narrower at its end would be preferred. Apparatus 10*a* may be made in a range of sizes for use with different sized containers, and the inherent taper, i.e., the relative widths of bottom edge 14*a* and top edge 16*a*, may be varied also to accommodate liquids of varying viscosity.

Figure 1B:
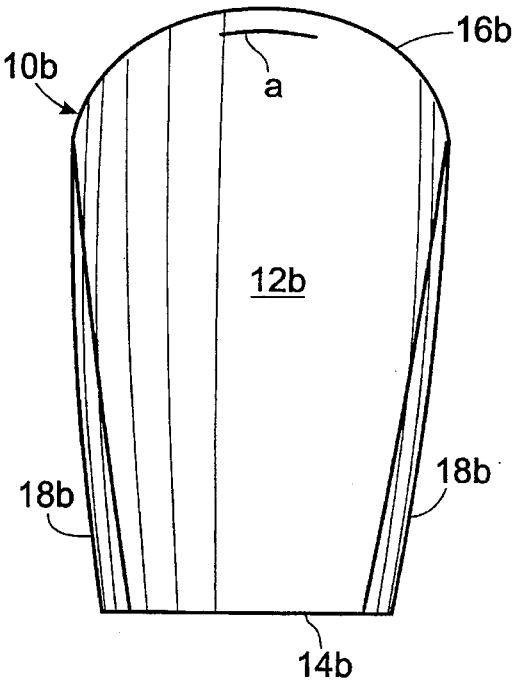

A variation in design that tapers outwardly is shown in FIG. 1*b*, i.e., so that top edge 16*b* is was wider than bottom edge 14*b*, and serves to specialize the particular instance of the device as a splash guard rather than a pouring spout. Conversely, a sharp taper inward serves to specialize such an instance of the device as a pouring spout rather than a splash guard. In the latter case, the design may also include at the apex of top surface 16*a* or 16*b* a V-shaped channel (not shown) so as to further facilitate pouring. In general, however, the universal character of apparatus 10*a* or 10*b* allows the use thereof as both a splash guard and a pouring spout.

Figure 2:
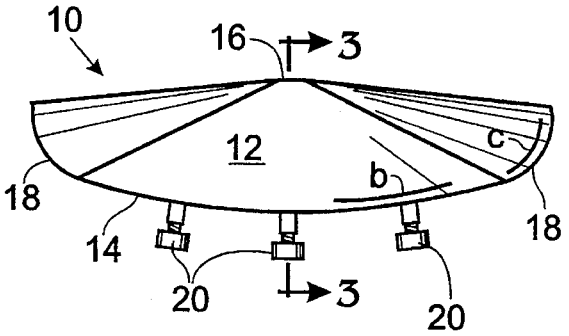
FIG. 2 shows a bottom perspective view of the embodiment of FIG. 1*a*.

Using numbers without an "a" or "b" now to refer to the corresponding numbers of either the "a" or "b" embodiment, it is seen in both FIGS. 1 and 2, sheet 12 is contiguous on each side with a curved portion 18. As best seen in FIG. 2, sheet 12 may itself be curved, e.g., so as to attain a radius of curvature b to accommodate the curvature of a container into which apparatus 10 (and specifically lower edge 14) is to be placed. Curvature b may also be flattened out, i.e., as described by an infinite radius of curvature, as would be used when applied to a rectangular container having flat walls. Depending upon the types of liquids for which apparatus 10 is intended to be used, and the degree of use, sheet 12 may be of a flexible material as previously stated, or may be made into a rigid form for heavy duty, single-purpose use. In either case, however, curved portions 18 are provided with a fixed degree of curvature c derived from a radius of curvature that is smaller than that pertaining to curvature b, whereby curved portions 18 act as retaining walls so as to retain therebetween any liquid that may be poured along sheet 12. The interior surfaces of sheet 12 and curved portions 18 may be coated with a non-stick material, or with other types of protective coating for use with corrosive liquids. As is also shown in FIG. 2, apparatus 10 further comprises several clips 20 which, as will now be shown, serve to attach apparatus 10 to a container from or into which a quantity of liquid is to be poured.

Figure 3:
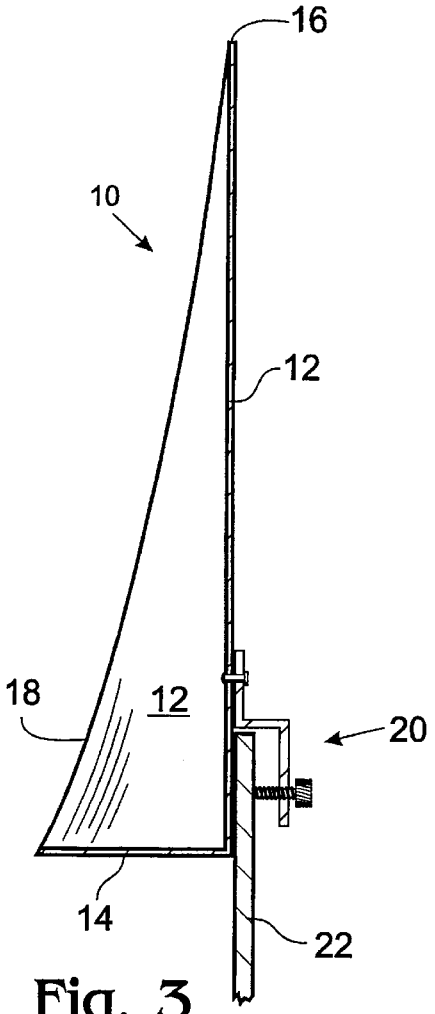
FIG. 3 shows in cross-section a side view of the embodiment of FIGS. 1*a* and 2, taken through the lines 3—3' of FIG. 2.

FIG. 3, which is a vertical cross-sectional view of apparatus 10 taken along the line 3—3' of FIG. 2, shows rather more clearly the taper of both sheet 12 and curved portions 18 in proceeding from bottom edge 18 to top edge 16. Clip 20 is also shown in cross-section, in this case attached to a side wall 22 of a container.

Figure 4:
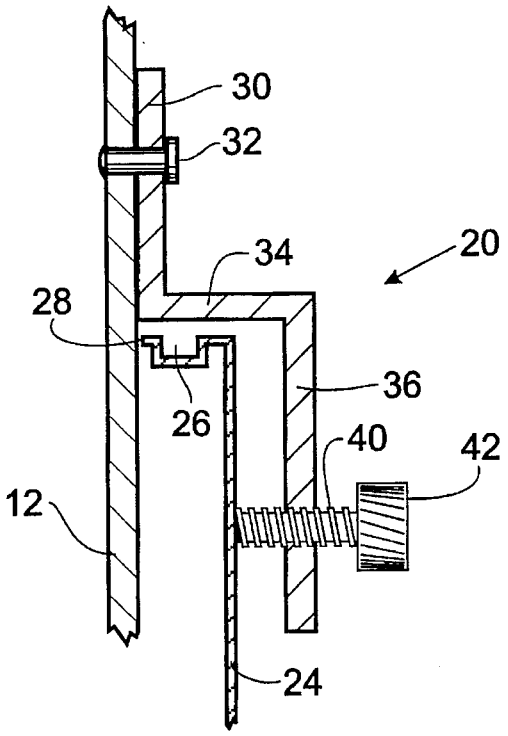
FIG. 4 shows an enlarged view of the clip of FIG. 3 that illustrates use thereof with a paint can or any other walled container.
Figure 5:
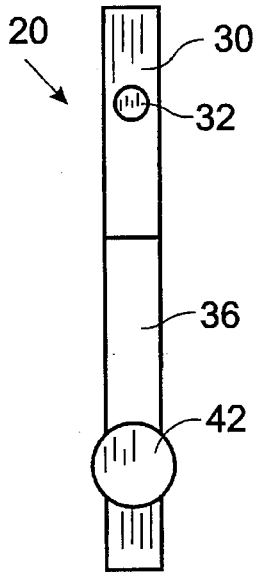
FIG. 5 shows a front elevation view of the clip alone of FIG. 4.

FIG. 4 shows in cross-section and at a larger scale a preferred embodiment of clip 20. A corresponding front elevation view of the clip 20 of FIG. 4 is shown in FIG. 5. Also clearly shown in FIG. 4 is that a side wall 24 to which clip 20 is to be attached may perhaps be of the type pertaining to a paint can, but need not be since none of the features such as a top annular channel 26 that characterize a paint can participate in the mounting of apparatus 10 to side wall 24 except for inner rim 28. That is, clip 20 attaches just as well to side wall 24 of FIG. 4 or to a wall such as wall 22 of FIG. 3 that is flat both inside and outside. The use of clips such as clip 20, together with the semi-rigid but yet flexible nature of sheet 12 (so as to accommodate both rounded or cylindrical containers and rectangular containers), establishes apparatus 10 as being "universal" in nature, i.e., apparatus 10 can be used with any container large enough to accommodate the same that has an accessible external wall and an opening disposed inward therefrom, including not only paint cans but also kitchen sauce pans, laboratory glassware, and the like.

In more detail, clip 20 in FIGS. 4 and 5 comprises a mounting plate 30 that is attached to the exterior side of sheet 12 by conventional means, e.g., as by rivet 32. Extending outwardly from mounting plate 30 is a strut 34, which has a length greater than the width of that part of the top of a can lying between an interior opening and an external wall such as side wall 24. Clip plate 36 extends at right angles to the distal end of strut 34 so as to lie parallel with sheet 12. Included within clip plate 36 are means for attaching apparatus 10 to such a can wall, e.g., as by a threaded bolt 40 having at the outer end thereof a knurled knob 42 by which threaded bolt 40 may conveniently be turned in and out. As shown In FIG. 4, turning threaded bolt 40 inwardly so as to come into contact with an exterior wall of a can such as side wall 24 very simply and quickly accomplishes attachment of apparatus 10 to a can whereby sheet 12 then extends downwardly therewithin and upwardly therefrom.

Figure 6:
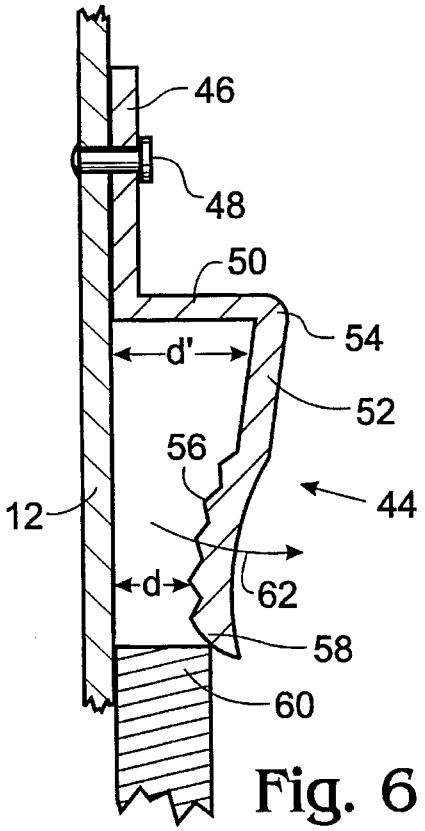
FIG. 6 shows a pressure-contact type of clip for attaching the invention to a container.
Figure 7:
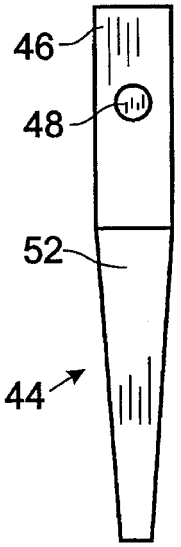
FIG. 7 shows a front elevation view of the clip alone of FIG. 6.

Alternative means for attaching apparatus 10 to a can wall are shown in clip 44 of FIGS. 6 and 7. Clip 44 includes a mounting plate 46 that attaches to the exterior side of sheet 12, e.g., by a rivet 48, and has a strut 50 extending outwardly from one end of mounting plate 46. Extending at right angles from the distal end of strut 50 is a contact arm 52, which attaches to strut 50 by a flexible knee 54. Towards the distal end of contact arm 52, on the side thereof facing sheet 12, there are placed a series of corrugations 56 that are adapted to make frictional contact with a can wall inserted therebehind. At the distal end of contact arm 52 is a curved portion 58 that is adapted to slide past a corner of a can wall such can wall 60 that is inserted therein.

Contact arm 52 is preferably formed so as to curve inwardly towards sheet 12. The degree of such curvature and the length of strut 50 are preferably selected so that the distance d between the exterior side of sheet 12 and the interior side of contact arm 52 at corrugations 56 will generally be less than the width of a can wall to be inserted therein. In such case, as shown in FIG. 6, when a can wall 60 has a width that exceeds the distance d, contact arm 52 is enabled by the flexibility of knee 54 to bend outwardly in the direction of arrow 62, and thus to establish a firm frictional and tensional connection between apparatus 10 and a can wall such as wall 60 upon inserting can wall 60 further between the exterior side of sheet 12 and the interior side of contact arm 52. Also, the length of strut 50 is preferably selected so that the distance d' between sheet 12 and contact arm 52 as measured near the proximal end of contact arm will suffice to accommodate therebetween a can wall of any size likely to be encountered.

Installation of that embodiment of apparatus 10 which employs clips such as clip 44 thus involves the simple steps of bending sheet 12 to approximate the radius of curvature of the can to which apparatus 10 is to be attached; slipping sheet 12 commencing at end 14 thereof into the interior of the can, and then lowering apparatus 10 until the side walls of the can have been slipped behind contact arms 44 of several of such clips, e.g., as in the use of three clips 20 as shown in FIG. 2. Simply pulling apparatus 10 upwardly from such a can wall will then effect the removal of apparatus 10 therefrom.

It will be understood by those of ordinary skill in the art that other arrangements and disposition of the aforesaid components, the descriptions of which are intended to be illustrative only and not limiting, may be made without departing from the spirit and scope of the invention, which must be identified and determined only from the following claims and equivalents thereof.

I claim:

1. A device for pouring and preventing splashing of liquids comprising:

an elongate central sheet having respectively opposite sides and ends and an inner and an outer surface;

clipping means for detachably holding said outer surface of said central sheet against an inner surface of a wall of a container adapted to hold a liquid, said clipping means further comprising:

a mounting plate attached to said outer surface of said central sheet;

a strut contiguous to said mounting plate and extending outwardly therefrom; and a contact arm contiguous to said strut at a juncture at the distal end thereof and extending outwardly therefrom to lie essentially parallel with said outer surface of said central sheet.

2. The device of claim 1 wherein said central sheet has an upper, curved edge over which liquid may be poured or against which liquid may be splashed, and a lower, flat edge for insertion within a container.

3. The device of claim 2 wherein said central sheet has a taper such that said upper edge is narrower in width than said lower edge.

4. The device of claim 2 wherein said central sheet has a taper such that said upper edge is broader in width than said lower edge.

5. The device of claim 1 further comprising a flexible knee at said juncture.

6. The device of claim 1 wherein said contact arm is curved convexly towards said outer surface of said central sheet to provide an inward-facing curved portion.

7. The device of claim 6 wherein said inward-facing curved portion further comprises a multiplicity of corrugations.

8. The device of claim 1 wherein said contact arm further comprises at the distal end, thereof a curved portion adapted for sliding engagement with an outer edge of a top portion of an outer wall of a container.

* * * * *